US005622269A

United States Patent [19]

Seymour et al.

[11] Patent Number: 5,622,269

[45] Date of Patent: Apr. 22, 1997

[54] APPARATUS AND METHOD OF ITEM JOGGING WITH REGISTRATION-BARRIER CUTOUT TO PASS UNDER-HEIGHT ITEMS

[75] Inventors: Thomas A. Seymour, Orange Park; Edward A. Green, Jacksonville; Richard Pralat, Deltona, all of Fla.

[73] Assignee: Unisys Corporation, Blue Bell, Pa.

[21] Appl. No.: 564,750

[22] Filed: Nov. 29, 1995

[51] Int. Cl.[6] ..... B07B 13/05

[52] U.S. Cl. ..... 209/680; 271/210

[58] Field of Search ..... 271/140, 210, 271/220–222; 209/660, 659, 675, 680, 682, 702, 920

[56] References Cited

U.S. PATENT DOCUMENTS

| | | | |
|---|---|---|---|
| 2,650,109 | 8/1953 | Johnson | 271/210 X |
| 3,223,410 | 12/1965 | Wilson et al. | 271/210 |
| 3,946,879 | 3/1976 | Jensen | 271/210 X |
| 4,662,522 | 5/1987 | Kokubun et al. | 209/682 X |
| 5,154,038 | 10/1992 | Capaci | 209/680 X |

*Primary Examiner*—Boris Milef

*Attorney, Agent, or Firm*—John J. McCormack; Mark T. Starr

[57] ABSTRACT

A method for jogging bunches of standard-size documents of prescribed height mixed in with anomalous-size documents of lesser height, these standard-size documents to be shaken and tilted to register against a first-wall of a receptacle this method also involving: relieving the first wall to form a cutout to pass only the anomalous-size documents; providing a second-wall in the receptacle forward of the first-wall; and shaking the documents so as to register the forward edges of the anomalous-size documents against the second-wall after passing through the cutout.

18 Claims, 9 Drawing Sheets

APPARATUS AND METHOD OF ITEM JOGGING WITH REGISTRATION-BARRIER CUTOUT TO PASS UNDER-HEIGHT ITEMS

This relates to machine processing of checks and like unit records, and especially to "jogging" operations therefor.

BACKGROUND, FEATURES

Workers in the document processing arts (e.g., machine processing of checks) know that it is common to subject stacks of such unit-record documents to a "jogging" operation where the documents are confined and shaken on a flat surface (e.g., jogging table) to help align their lower edges.

A problem can develop when different-size documents are mixed-in e.g., when a stack of one-size checks includes different-size adding-machine tape, or the like. Since the automatic high-speed processing line is geared to the common size and weight of identical unit-record documents (e.g., checks), such "anomalous documents" (tapes) must be removed before machine processing—e.g., lest they cause a jam, a "reject condition" or a "mis-sort" or "feedcheck". Presently, an operator must inspect all check-stacks and manually find and remove each such tape. Of course, removing the adding machine tapes will improve throughput and result in fewer rejects. Rejects are an added expense because the check has to be rerun through another check processing machine. Thus, expedited tape-removal at the jogger is an object hereof.

Thus, an object hereof is to address and resolve at least some of these problems and provide at least some of the here-described features. A particular object is to separate tape items from stacks of checks. A more particular object is to remove adding machine tapes from bundles of checks prior to feeding the checks through a check processing machine—e.g., doing so in a jogger, while allowing for adding machine tapes to jog down against a novel storage zone therefor and be easily seen and removed.

Other objects and advantages of the present invention will be apparent to those skilled in the art.

BRIEF DESCRIPTION OF THE DRAWINGS

The foregoing and other features and advantages of the present invention will be appreciated by workers as they become better understood by reference to the following detailed description of the present preferred embodiments, these being considered in conjunction with the accompanying drawings, wherein like reference symbols denote like elements:

FIG. 4 is a side sectional view showing an exemplary check stack ch in a like jogger-tray 1' without the tape-separating space etc.; while

EMBODIMENT DETAILS

Figure 1:
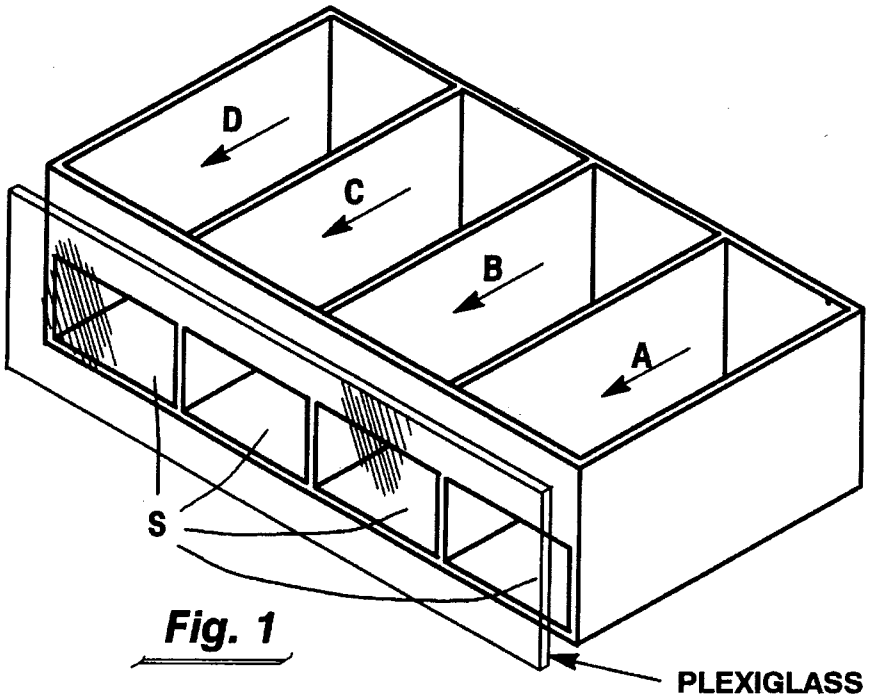
FIG. 1 is a very schematic, idealized showing of a novel check-jogger tray which includes a tape-segregating area according to an embodiment of the invention.
Figure 2:
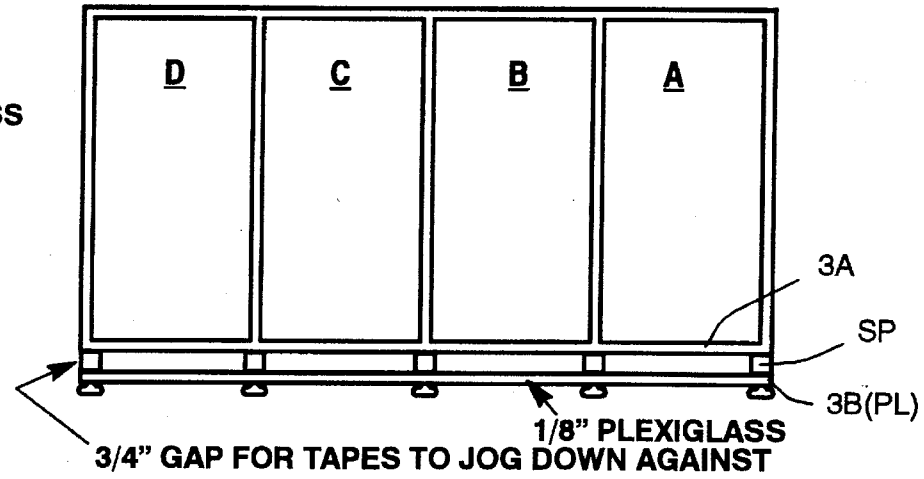
FIG. 2 gives a plan view thereof (FIG. 2A including several check tape bunches merged into a stack ST), and FIG. 3 a front view thereof.
Figure 3:
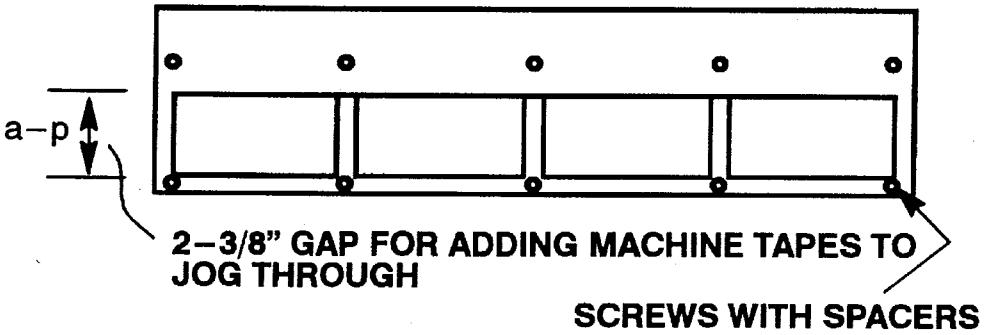
Figure 10:
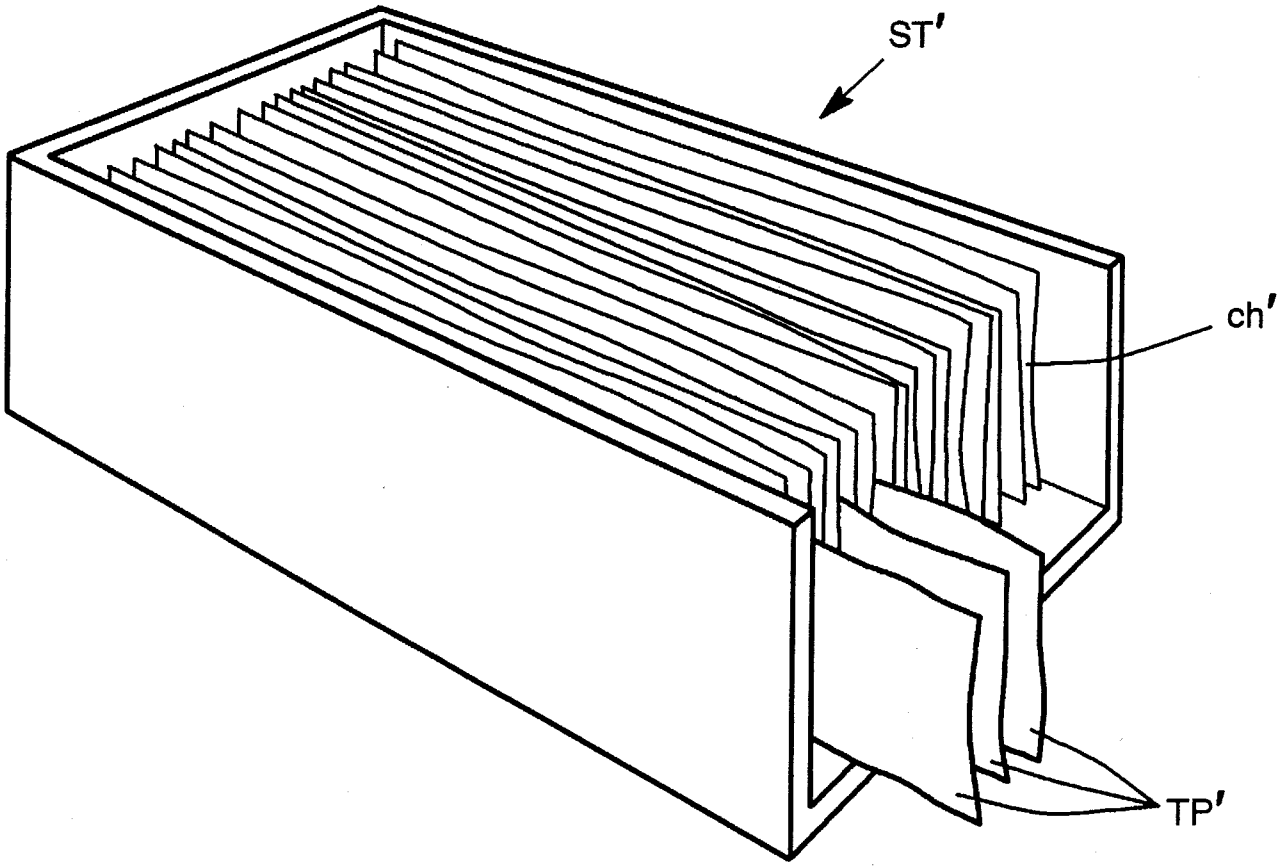
FIG. 10 schematically illustrates a sample array of "fully-jogged" check bunches incorporated into a stack ST', with separated tapes TP' shown protruding therefrom.

A preferred embodiment is depicted in FIG. 1–3 where a base-unit of a 4-pocket check-jogger 1 is modified, according to the invention, to facilitate separation and extraction of adding machine tapes from bundles of checks prior to running these checks through a check sorting machine. This embodiment allows the adding machine tapes to be easily detected, by protruding out further than the rest of the bundle of checks (e.g., as seen in FIG. 10). When an operator picks up the stack checks/tapes (e.g., after jogging in our embodiment) he can then more readily see and remove the adding machine tapes and then insert the bunch of tape-removed checks into a machine to be processed. Extracting these tapes, allows the checks to be processed more efficiently. This, in turn, improves throughput of check sorters, by avoiding jams, missorts, and needless rejects. These problems cost money; e.g., they can retard processing of checks or can force one to run rejects through slower check sorting equipment.

FIG. 1 gives an idealized upper perspective of a jogger tray 1 which, according to a preferred embodiment, includes a see-through storage area S for receiving adding machine tapes, or like "anomalous documents". Tray 1 is adapted to receive stacks of standard-size documents (e.g., checks 6" long×2¾" high) in various pockets (e.g., four like pockets shown: A,B,C,D) which are each roughly as long as a check-length. Tray 1 will be understood as to be mounted on a mechanical jogger (or shaker) means JB' adapted to fit the in-tray check stacks down toward their "front-edges" (direction of arrows) and shake it sufficient to quickly align one edge of all checks in a stack or bundle. Tray 1 will generally comprise a flat base b and four like walls (front, back, side) with separators for each pocket.

After the requisite shaking (jogging) and when such alignment is complete, a single stack of checks can be picked up from each pocket and injected into an automatic check processor machine (not shown, but well known in the art). But, as mentioned, any "tapes" or other "anomalous-size" documents must first be removed and not so processed.

Here, we assume that the checks are all 6 inches long by 2¾ inches high, while the tapes are smaller (e.g., about 4–5 inches long by 2–2¼ inches high).

Figure 4:
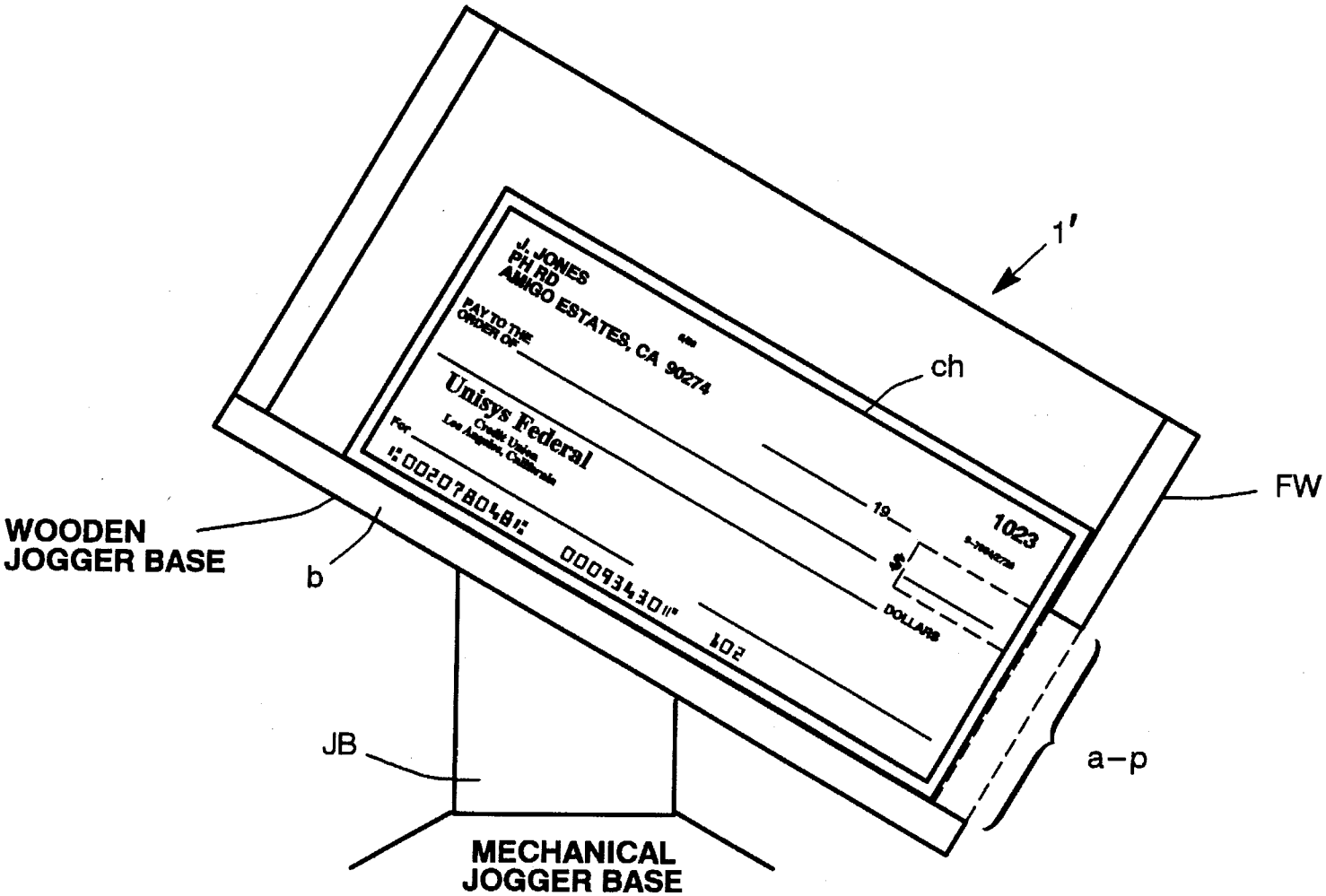
Figure 5:
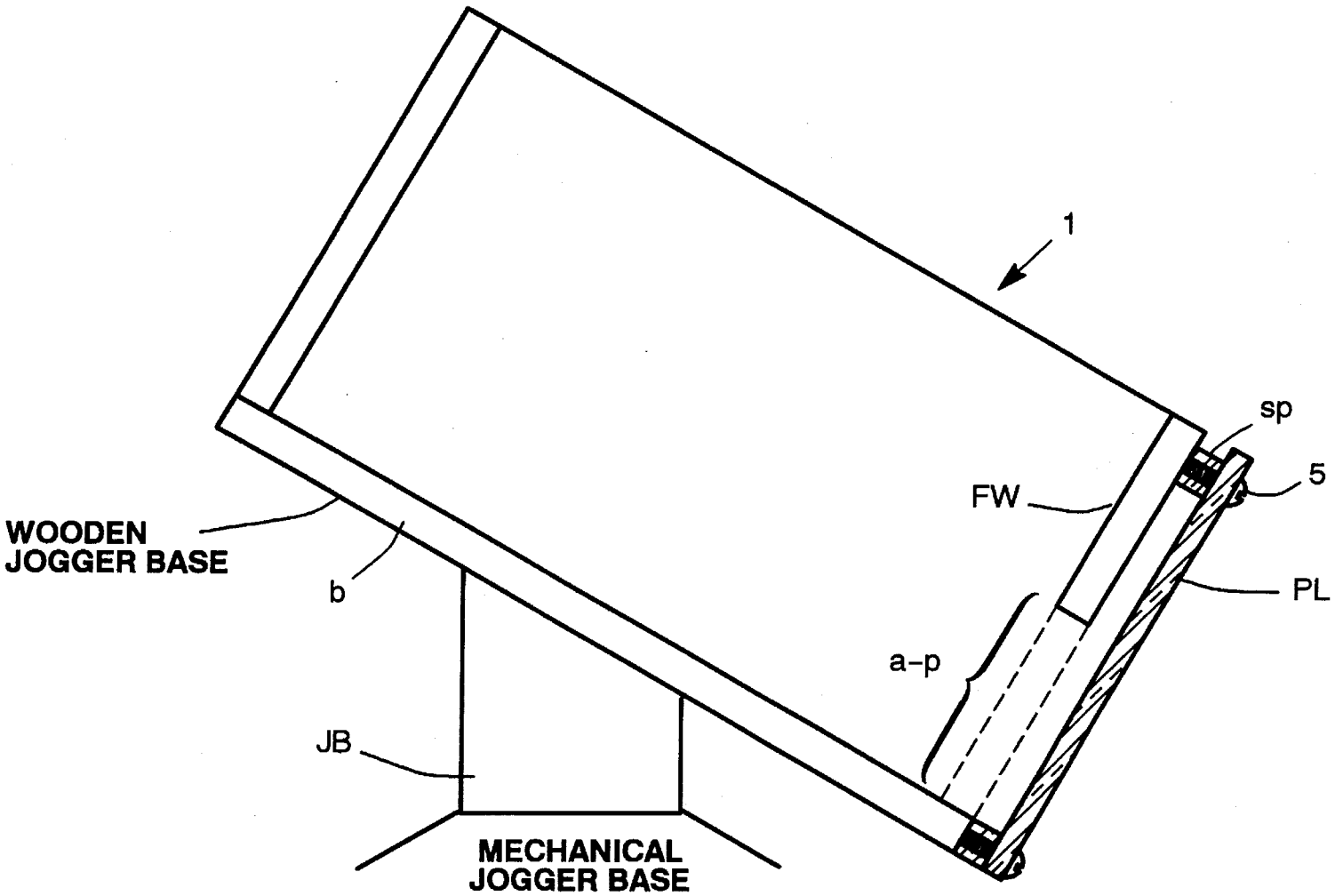
FIG. 5 shows the same with transparent wall PL added to create this space.
Figure 6:
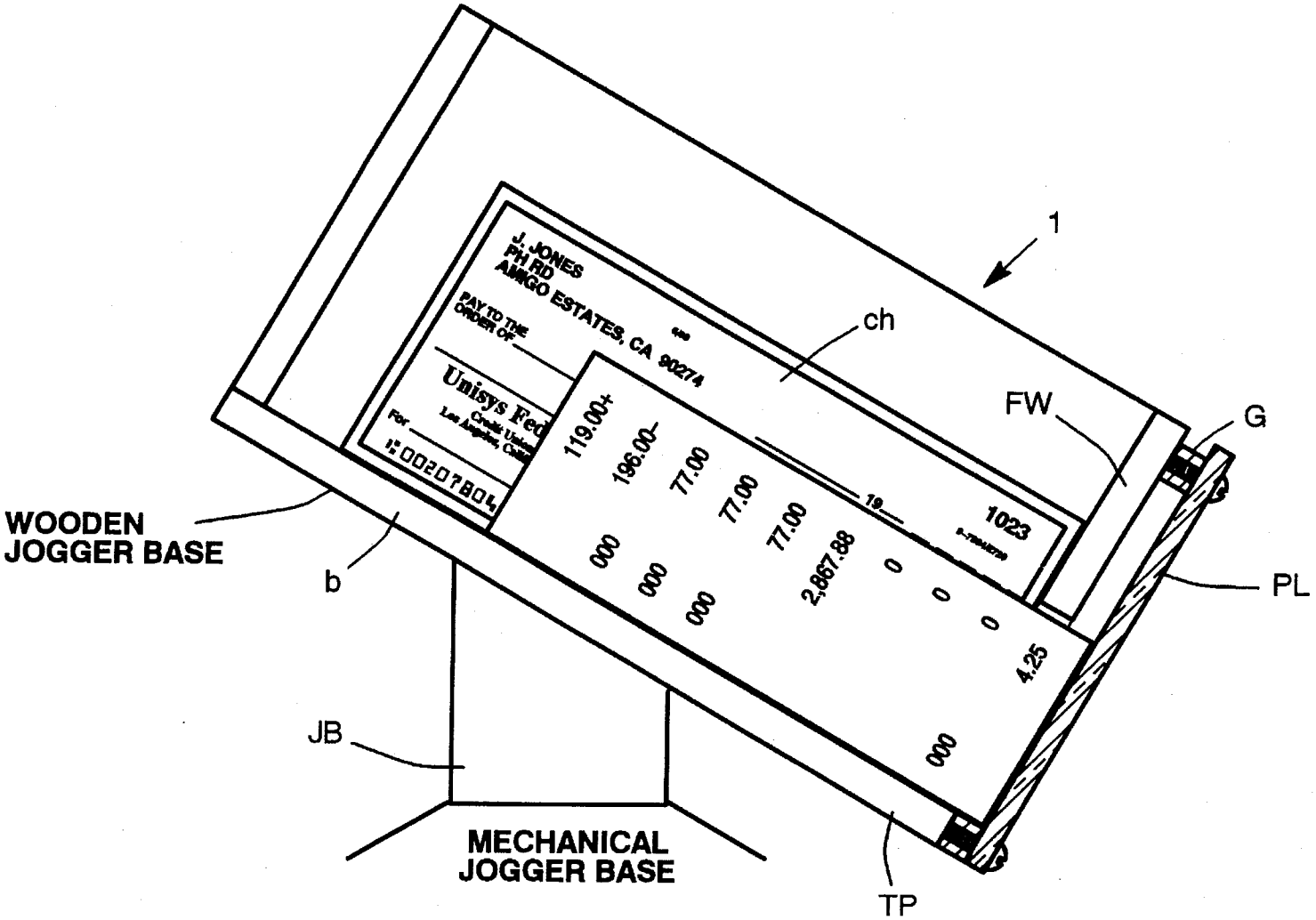
FIG. 6 shows the FIG. 5 construction with checks ch and tapes TP therein.

According to a feature of this embodiment, the front wall Fw of tray 1 (e.g., see FIGS. 1–6) includes a recess S to receive protruding tapes (e.g., as in FIGS. 6, 10). Preferably, this is provided by constructing wall Fw as a "stop", to leave a lower aperture a-p sized and located so each of the four compartments will admit protrusion of the tapes TP. Aperture a-p will thus be less than a check-height and a bit more than "tape-height" (e.g. here about 2⅜" high for checks 2¾" high, or more, and for tapes 2¼" high, or less—e.g., see FIGS. 4–6).

Figure 2A:
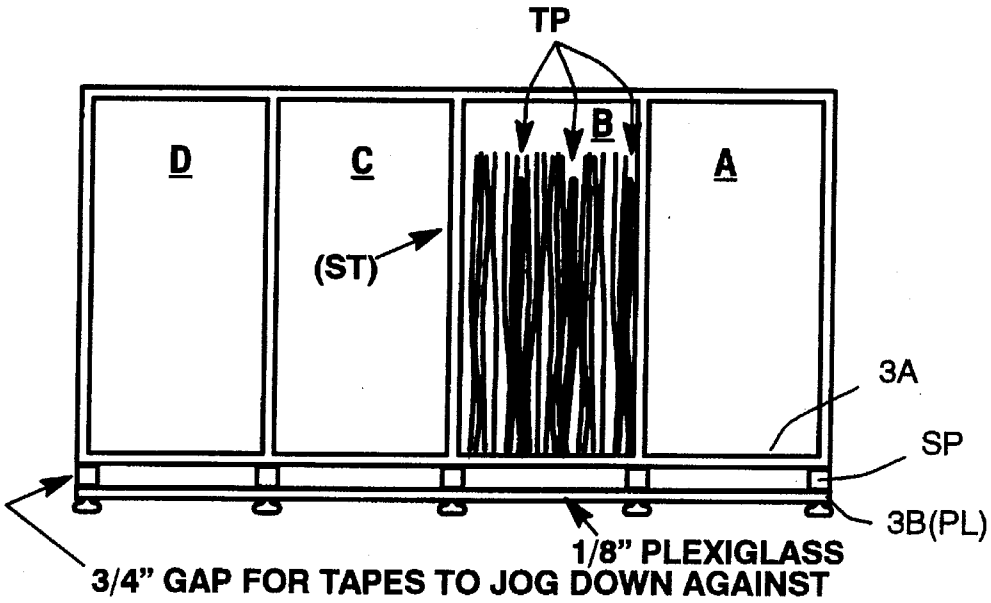

Also, a transparent Gap-Wall PL is added (e.g., see FIGS. 5, 6, where added to tray 1' in FIG. 4) and preferably spaced from wall Fw sufficient to establish a "protrusion space" p-s for the tapes—to be shaken-down beyond a stack of checks in a tray-pocket, to emerge therein, protruding from their respective stacks (e.g., as in FIG. 2A, where the bundle ST' shown in pocket B of tray 1 is understood to be shaken-down by the shown embodiment to leave its three tapes TP protruding from the multi-stack bundle so-shaken therein—e.g., as in FIG. 10—and, as workers realize, an operator may readily extract bundle ST from such a pocket B and easily remove protruding tapes TP therefrom).

Wall PL is preferably made transparent to allow operators to "eyeball" the tape-check stacks inserted in the embodiment tray and quickly detect any problems (e.g., ⅛" Plexiglas is preferred here, secured to Tray 1 via fastening means and spacers e.g., screws SC and rubber spacers SP to help set gap G, FIG. 6—along with the thickness of stop Fw. Here, the spacers SP are about ½" long, and wall Fw is about ¼ thick to thus establish a protrusion-gap p-g of about ¾").

FIGS. 1–6 will thus be understood as showing a modified 4-pocket jogger tray 1' with cutouts (pref. 2⅜" high) to allow only tapes to slip under stop-wall Fw and rest vs clear Plexiglas front-wall PL, allowing an operator to notice, and remove, the tapes from a check-bundle being jogged. Preferably, the protrusion-gap G is made about ¾" long (by spacers SP, between walls Fw, PL and by the width of stop-wall Fw). Gap G allows the adding machine tapes to fall down against the Plexiglas wall PL, so a "work prep" person can remove these tapes from the work to be run through the check sorter machine. Removing these tapes will reduce jams, feedchecks, and rejects (which-cost money). This will increase performance and throughput.

Figure 7:
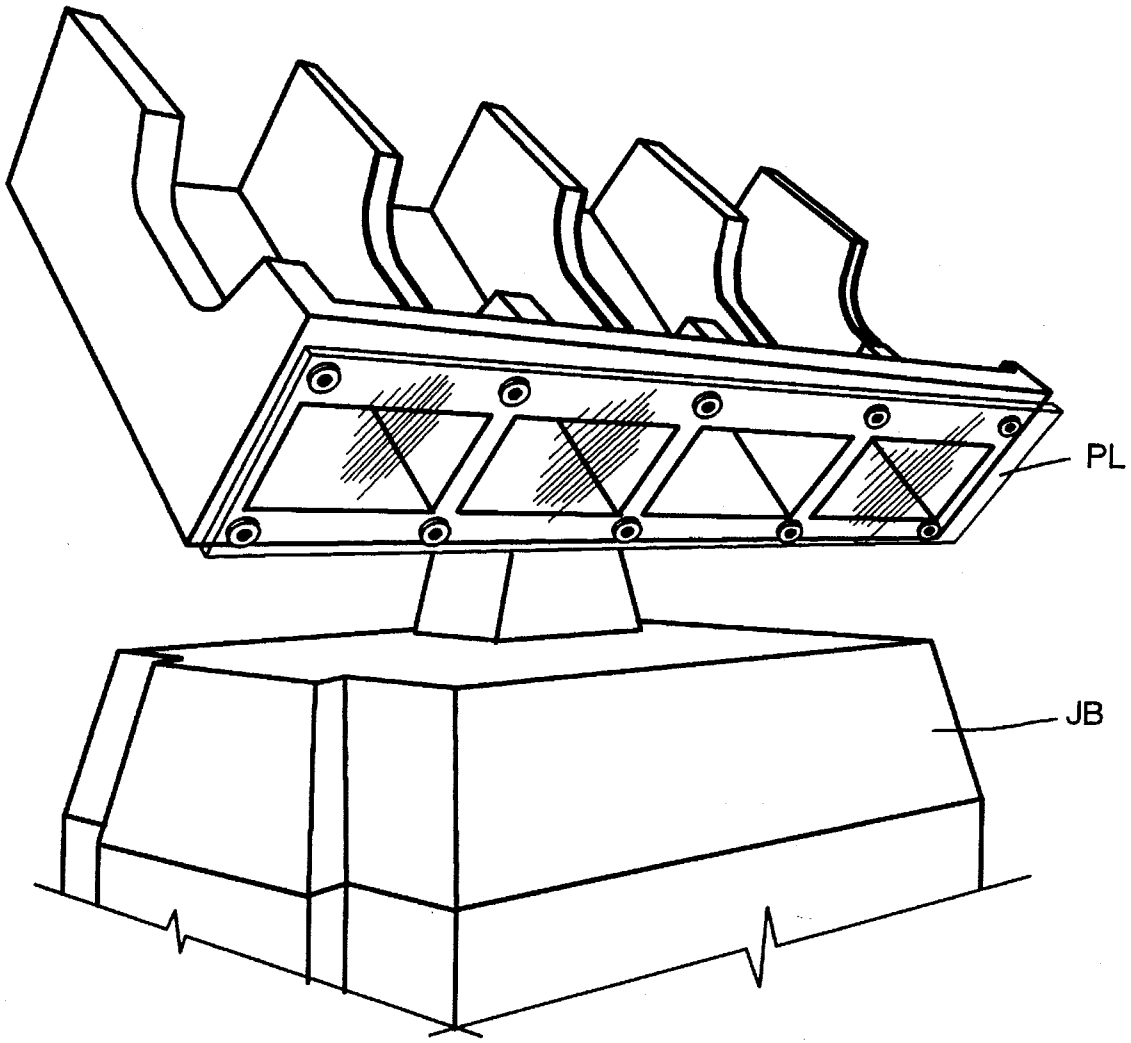
FIGS. 7–9 reproduce photographs of a mock-up of such a modified jogger tray in various views.
Figure 8:
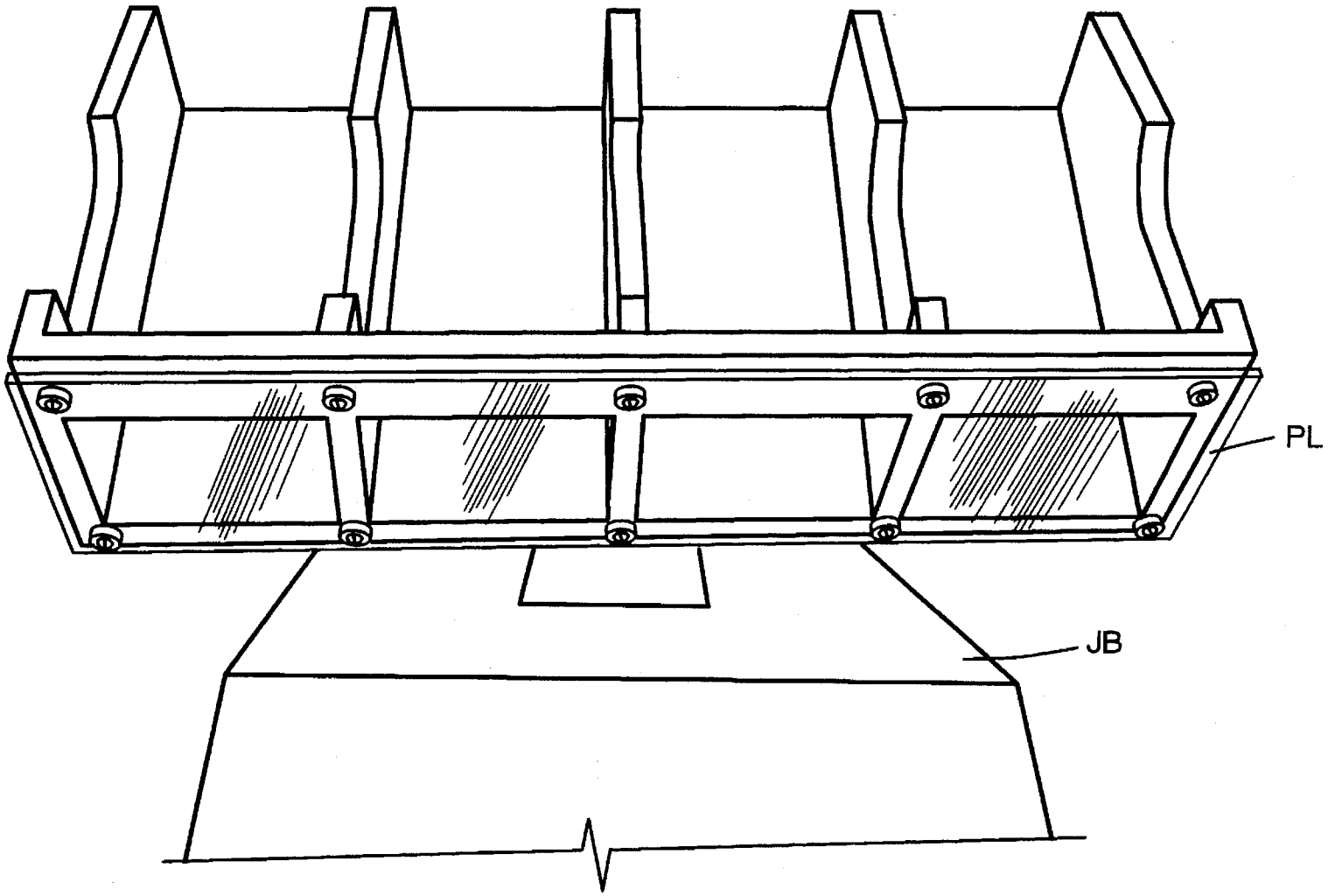
Figure 9:
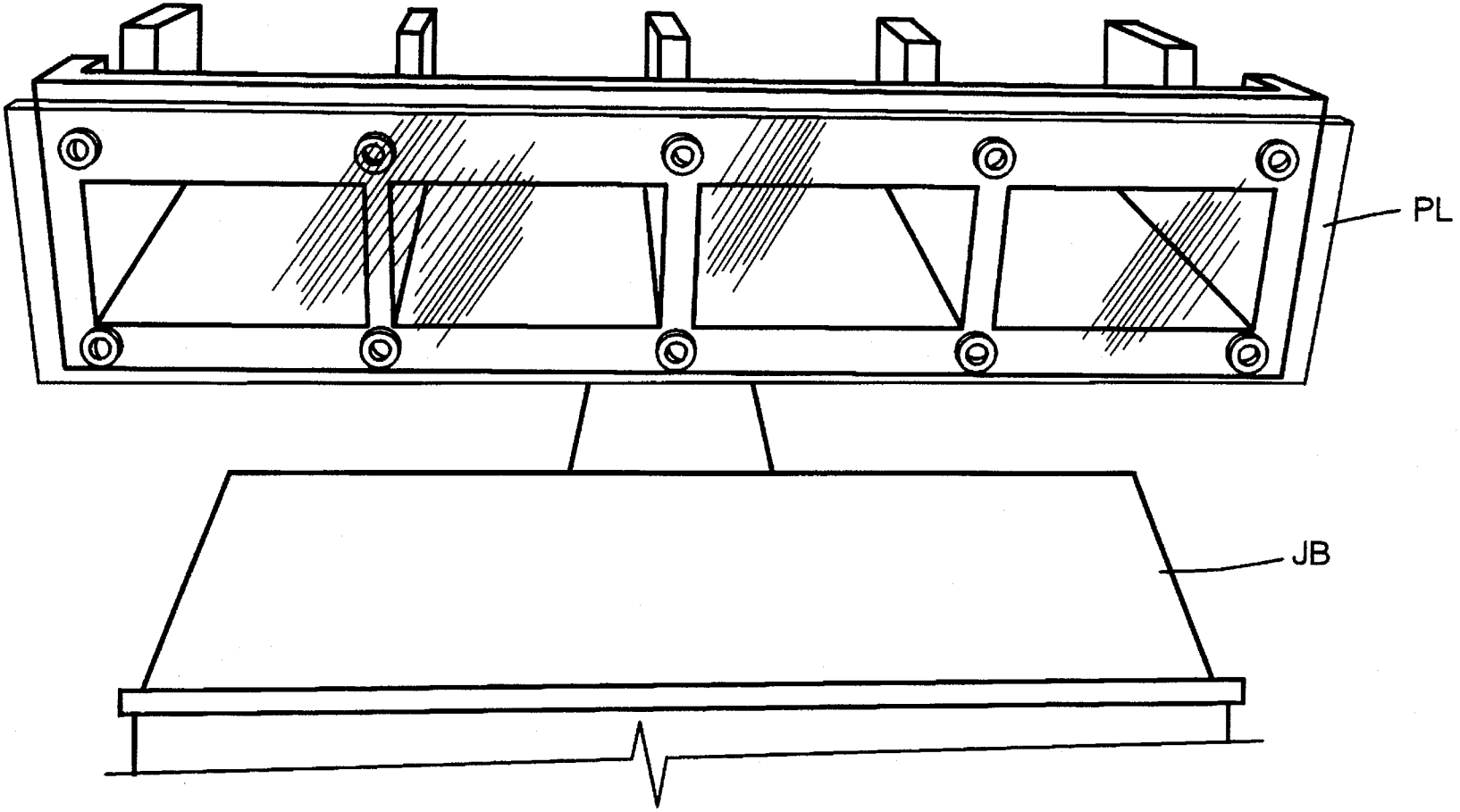

FIGS. 7–9, replicate photographs of a mock-up of such a modified Jogger-tray 1, shown there in various views (e.g., upper-perspective, side view in FIG. 7; in upper-perspective front view in FIG. 8 and in front, elevation in FIG. 9).

RESULTS

It will be apparent that our aforedescribed invention is apt for effecting the objects mentioned; e.g., to separate "anomalous-sized" documents from "standard-size" documents stacked in a jogger or like receptacle.

It will be evident that this separation is preferably effected by providing a forward stop-wall above an "under-height" passageway and associated tape-edge storage area in the "front" of leading-wall of such a receptacle.

Of course, modifications to the preferred embodiment described are possible without departing from the spirit of the present invention. For example, there are other different ways to provide such a stop-wall, such a separation-aperture and/or such an associated storage zone, and the invention is not limited to the particular types of receptacles, joggers or the particular types of "standard unit record" documents or tapes described. Additionally, some features of the present invention can be used to advantage without the corresponding use of other features.

For instance, in certain cases the forward wall PL need not be transparent; also in related cases, wall PL may simply abut stop-wail Fw, whose thickness, alone, will thereby define the "tape-protrusion-space".

Accordingly, the description of the preferred embodiment should be to be considered as including all possible modifications and variations coming within the scope of the invention as defined by the appended claims.

What is claimed is:

1. A method for jogging one or several bunches of standard-size documents of prescribed height mixed in with anomalous-size documents of lesser height, these standard-size documents to be shaken and tilted to register a forward edge of said standard-size documents against a prescribed first wall of a receptacle, this method comprising the steps of:

relieving said first wall to form a cutout to pass only said anomalous-size documents; providing a second wall in said receptacle spaced a prescribed protrusion-distance $d_p$ forward of said first wall; and shaking all said documents so as to register only the forward edges of said anomalous-size documents against said second wall after passing through said first wall.

2. The method of claim 1, further comprising the step of forming said cutout to exhibit a height CH at least greater than the height AH of said anomalous-size documents and less than the height SH of said standard-size documents.

3. The method of claim 1, wherein said protrusion-distance $d_p$ is at least sufficient for an operator to perceive and remove said anomalous-size documents from each said bunch once the bunch is fully shaken-down and removed from said receptacle.

4. The method of claim 3, wherein said distance $d_p$ is defined by the thickness of said first wall plus a forward separation distance spaced therefrom.

5. The method of claim 4, wherein said separation distance is defined by prescribed separator means between said walls.

6. The method of claim 4, wherein said second wall is transparent.

7. The method of claim 6, wherein said standard-size documents are checks.

8. The method of claim 7, wherein said anomalous-size documents are adding machine tapes.

9. The method of claim 8, wherein said checks are so-jogged to prepare them for insertion into automatic check-processing equipment.

10. The method of claim 9, wherein said checks are about 2¾" high or more.

11. The method of claim 10, wherein said tapes are about 2¼" high or less.

12. The method of claim 11, wherein said cutout is between 2¾" and 2¼" high.

13. The method of claim 1, wherein said second wall is transparent.

14. A method for jogging one or several bunches of first-size documents of prescribed height mixed in with anomalous-size documents of lesser height, these first-size documents to be shaken and tilted to register a forward edge of said first-size documents against a prescribed first wall of a receptacle, this method comprising the steps of:

relieving said first wall to form a cutout to pass only said anomalous-size documents; providing a second wall in said receptacle spaced forward of said first wall; and shaking all said documents to pass said anomalous-size documents through said cutout and register said anomalous-size documents against said second wall.

15. A method for jogging one or several bunches of first-size documents of prescribed minimum height SH, mixed in with anomalous-size documents of lesser height, these first-size documents to be shaken and tilted to register a forward edge of the first-size documents against a prescribed first wall of a receptacle, this method comprising the steps of:

relieving said first wall to form cutout means to pass only said anomalous-size documents; providing a second wall of said receptacle spaced a prescribed protrusion-distance forward of said first wall; and shaking all said documents so as to register only the forward edges of said anomalous-size documents against said second wall after passing through said cutout means in said first wall.

16. The method of claim 15, further comprising the step of forming said cutout means to exhibit a height CH at least greater than the maximum height AH of said anomalous-size documents and less than the height SH of said first-size documents.

17. A method for jogging one or several bunches of first-size documents of prescribed minimum height mixed in with anomalous-size documents of lesser height, these first-size documents to be shaken and tilted to register a forward edge of the first-size documents against a prescribed first wall of a receptacle means, this method comprising the steps of:

relieving said first wall to form cutout means arranged to pass only said anomalous-size documents; providing a second wall in said receptacle means, spaced forward of said first wall; and shaking all said documents to pass said anomalous-size documents through said cutout means and register them against said second wall.

18. A method for jogging one or several bunches of first-size documents of prescribed minimum height mixed in with anomalous-size documents of lesser height, these documents to be shaken and tilted in a prescribed receptacle means, this method comprising the steps of:

providing a first barrier means in said receptacle means to register the leading edges of said first-size documents; providing a second barrier means in said receptacle means, spaced beyond said first barrier means and arranged to register the leading edges of said anomalous-size documents;

relieving said first barrier means with cutout means to allow only said anomalous-size documents to pass therebeyond; and shaking/tilting all said documents in said receptacle means so that said first-size documents are so registered against said first barrier means, and so that said anomalous-size documents pass beyond said first barrier means via said cutout means, and are so registered against said second barrier means.

* * * * *